United States Patent [19]

Blonder

[11] 4,218,686

[45] Aug. 19, 1980

[54] YAGI-TYPE ANTENNAS AND METHOD

[75] Inventor: Isaac S. Blonder, West Orange, N.J.

[73] Assignee: Blonder-Tongue Laboratories, Inc., Old Bridge, N.J.

[21] Appl. No.: 880,429

[22] Filed: Feb. 23, 1978

[51] Int. Cl.[2] ..... H01Q 1/02

[52] U.S. Cl. ..... 343/819; 343/893

[58] Field of Search ..... 343/819, 818, 797, 727, 343/730, 876, 893, 908

[56] References Cited

U.S. PATENT DOCUMENTS

| | | | |
|---|---|---|---|
| 2,992,430 | 7/1961 | Winegard | 343/819 |
| 3,155,976 | 11/1964 | Wickersham, Jr. et al. | 343/821 |
| 3,671,973 | 6/1972 | French | 343/819 |

FOREIGN PATENT DOCUMENTS

| | | | |
|---|---|---|---|
| 1396827 | 6/1975 | United Kingdom | 343/819 |

*Primary Examiner*—David K. Moore

*Attorney, Agent, or Firm*—Rhines and Rines; Shapiro and Shapiro

[57] ABSTRACT

This disclosure is concerned with compensating for unsymmetrical antenna receiving or transmitting patterns caused by unbalanced driven element feed, by compensatory unsymmetrical interaction with parasitic director and/or reflector elements.

22 Claims, 3 Drawing Figures

YAGI-TYPE ANTENNAS AND METHOD

Figure 1:
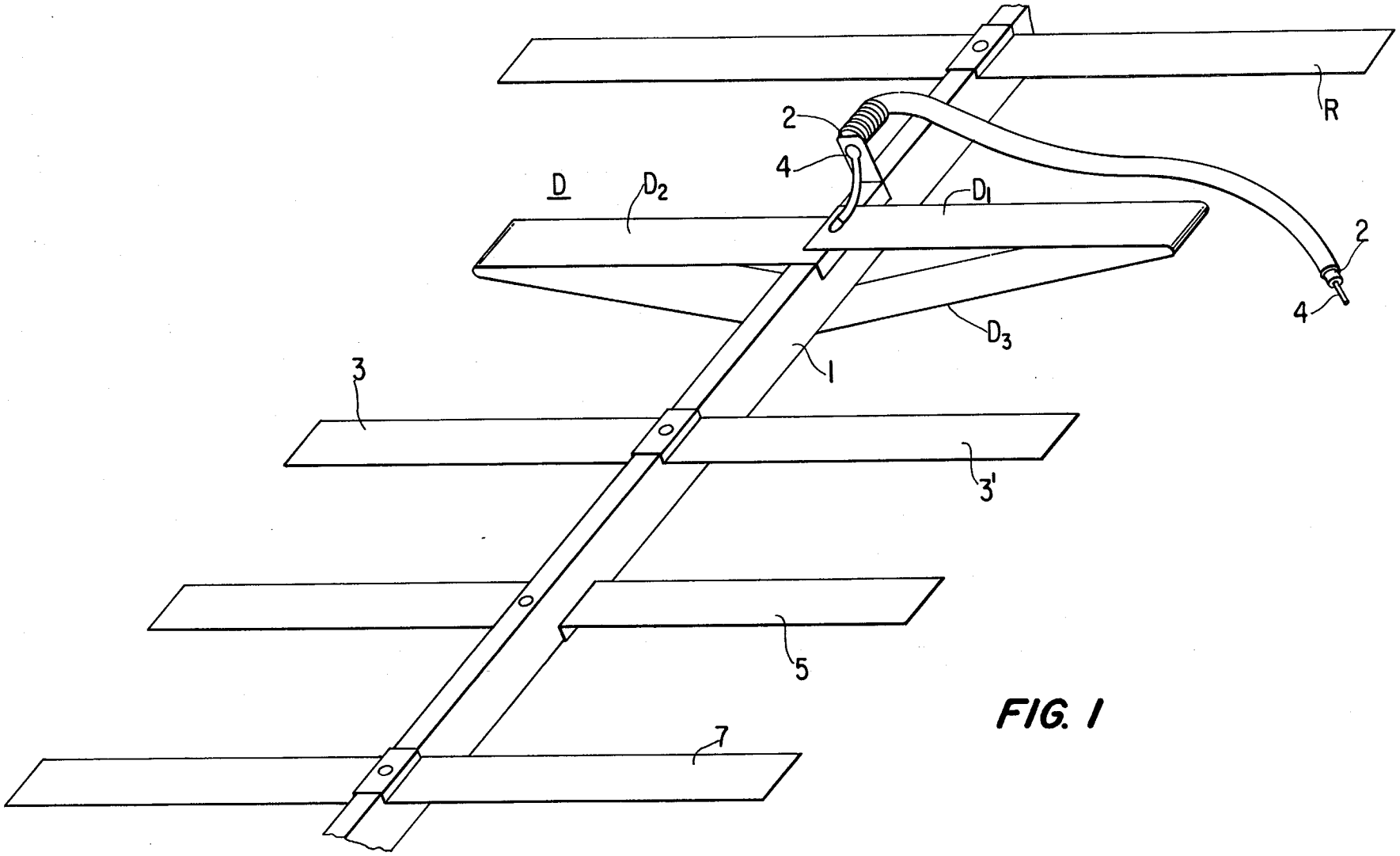

The present invention relates to antennas and methods of designing the same, being more particularly concerned with antennas embodying parasitic elements which, if used in a series of elements, have generically become termed "Yagi" antennas. That term is used herein in such a generic sense, it being understood that the invention is applicable wherever the same kind of operation involving the use of parasitic directors and reflectors may be employed.

Since Yagi announced his discovery that the directivity and gain of a driven dipole could be shaped and controlled through the use of parallel longitudinally spaced in-line parasitic reflector and director elements, respectively placed behind and in front of the driven element, there has been copious research into and utilization of this technique. The literature abounds with various types of modifications and utilizations of these principles as, for example, in my earlier U.S. Pat. Nos. 3,259,904; in 2,981,951; 3,114,913; 3,155,976; and 3,623,109; and in many articles, two more recent and comprehensive examples of which are D. K. Cheng and A. C. Chen "Optimum Element Spacings for Yagi-Uda Arrays", IEEE Transactions on Antennas and Propagation, Vol. AP-21, No. 5, September, 1973, commencing page 615; and "Yagi Antenna Design", National Bureau of Standards, U.S. Department of Commerce, NTIS PB-262885, December, 1976. In order to understand the operation of such parasitic arrays, copious theoretical analyses have also been made, but the number of variables involved in the spacing, number or elements, length-to-thickness ratios of the elements, and bands of frequencies over which the elements may be required to operate, have resulted in many different types of arrangements, arrived at more as a result of experimentation and art, than precise theory.

When this type of antenna became a standard for VHF radio and television, including UHF home reception, again many different variations of element design were adopted to enable such antennas to provide usually substantially maximum gain and uniform characteristics over multiple bands of frequencies, with some designs specially employed for particular selected problems, as described, for example, in the above-mentioned Letters Patent and the references therein. Depending, however, upon the variation of longitudinal spacings of the elements and the particular ranges of length-to-diameter or width of the parasitic elements themselves and the position of parasitic elements intended to operate at different frequencies or to perform different functions over different frequencies bands, the designs have been relatively critical and highly specialized in nature.

Additionally, the type of excited dipole or antenna system used has been found to require somewhat different approaches in connection with the use of parasitic elements. A balanced feed dipole, for example, generally requires a highly symmetrical type of parasitic array consideration; whereas an unbalanced feed, as by connecting a coaxial line to a folded dipole, introduces entirely different problems including asymmetrical patterns and impedance unbalances and the like which have given rise to specialized types of consideration in the configuration, spacings and nature of the parasitic elements, generally experimentally derived.

Underlying the present invention is a discovery that appears to be particularly adapted to such arrays employing unsymmetrical or unbalanced feed systems used with the driven dipole or similar elements. Summarily stated, it has been found that a vastly improved performance can surprisingly be obtained, consistently and in a stable manner, if certain parasitic elements, particularly the first director, spaced roughly a quarter of a wavelength in front of the driven element (generally of the order of two-tenths of the wavelength), is made unsymmetrical with respect to the center line of the array instead of having equal dimensional extensions on each side of the center line of the array, as is universally customary in arrays of this character. This lack of symmetry in the director may be extended to subsequent director elements, but the degree of improvement is less noticeable; so that it is the first element that is the most critical in requiring this asymmetrical treatment. In some instances, the second and/or third director of a large number of directors in the array may be thus rendered unsymmetrical, and in some systems a parasitic reflector may similarly be made unsymmetrical as later explained.

As reported, for example, in the National Bureau of Standards publication, supra, it has been observed that one cannot just continue to add parasitic directive elements and continue to improve the gain and other antenna performance characteristics. To the contrary, in some instances, the gain will proceed to drop as additional elements are added. In addition, particularly with asymmetrically fed or unbalanced-line-fed excited or driven elements, it has been observed that as additional directors are added, the impedance presented by the antenna will have discontinuities and dips in the response, and the corresponding performance at different frequencies in the desired band will have gaps and aberrations. Startingly, if the unsymmetrically fed driven element is provided with director element(s) having the unsymmetrical characteristics hereinafter described, this sensitivity to number of director elements and aberration in performance is remarkably minimized, the antenna performing in a stable substantially predictable manner, without deleterous effects as additional elements may be added, and without the dips in performance before mentioned. It has also been found, moreover, that the spacing between directors is not then as critical as is the case with prior systems.

An object of the invention is thus to provide a novel Yagi-type or similar antenna having the improved performance above discussed and a novel method of achieving the same.

A further object is to provide an improved antenna of more general character; and further objects are later discussed and delineated in the appended claims.

While the precise theory of operation is not required for the practice of the invention, it being sufficient to describe the structures necessary reliably to produce the novel results of the invention, and while there is no intention to predicate the invention upon any particular theory of operation, it may be helpful in understanding the phenomena involved to consider one of the possible theoretical explanations for these vastly improved results.

The typical driven element used for Yagi-type antennas fed by a coaxial line, employs a matching device, such as a gamma match, to match the impedance of the transmission line to that of the dipole. Usually, a single side or leg or portion of the driven element is fed by the inner conductor of the coaxial transmission line, the so-called "hot" side. The other side or leg or portion of the dipole is connected to the outer grounded coaxial line conductor and may be considered as an undriven side coupled magnetically (that is field-coupled or air-coupled) to the driven side of the dipole, and also electrically, in the case of folded dipoles, through the direct physical connection, via the folded element. This undriven side will thus have less energy induced along it than the side directly connected to the inner "hot" transmission line conductor, resulting in the production of an asymmetrical antenna pattern. When parasitic conductive directors are then placed in such a non-uniform electrical field, the performance of the directors is no longer predictable, because the extent and precise nature of the field are unknown. In accordance with the invention, it is endeavored to correct the asymmetrical field of the driven dipole by placing in front of the dipole a parasitic director having a longer transverse portion (physically and/or electrically longer) in the proximity of the undriven side of the dipole, preferably parallel thereto, to assist in restoring the strength of the field on that side and thereby re-establishing a symmetrical pattern. Correspondingly, the length of the transverse director portion parallel and in proximity to the driven side of the dipole is made shorter (physically and/or electrically), to reduce the energy directed from that side. This has been experimentally determined to introduce parasitic element interaction to compensate for the original unsymmetrical character of the dipole pattern and thus to render the antenna pattern substantially symmetrical; and, in addition, as further directors were added, no substantial dips in performance or deleterous effects accompanying previous antennas of this type were encountered.

In summary, from one of its broad aspects, the invention relates to an improved Yagi-type antenna having, in combination, coaxial-line-fed antenna means having one portion connected to the inner line and the other portion connected to the outer line of the coaxial line and thus producing an unsymmetrical pattern; and parasitic conductive means spaced from but near the said antenna means and comprising portions corresponding to and extending substantially parallel to the portions of the said antenna means, the parasitic conductive means portion corresponding to the said other portion of the said antenna means being of greater dimension that the portion corresponding to said one portion of the said antenna means to introduce compensatory unsymmetrical parasitic interaction to render the pattern symmetrical. Preferred details are hereinafter presented.

Figure 2:
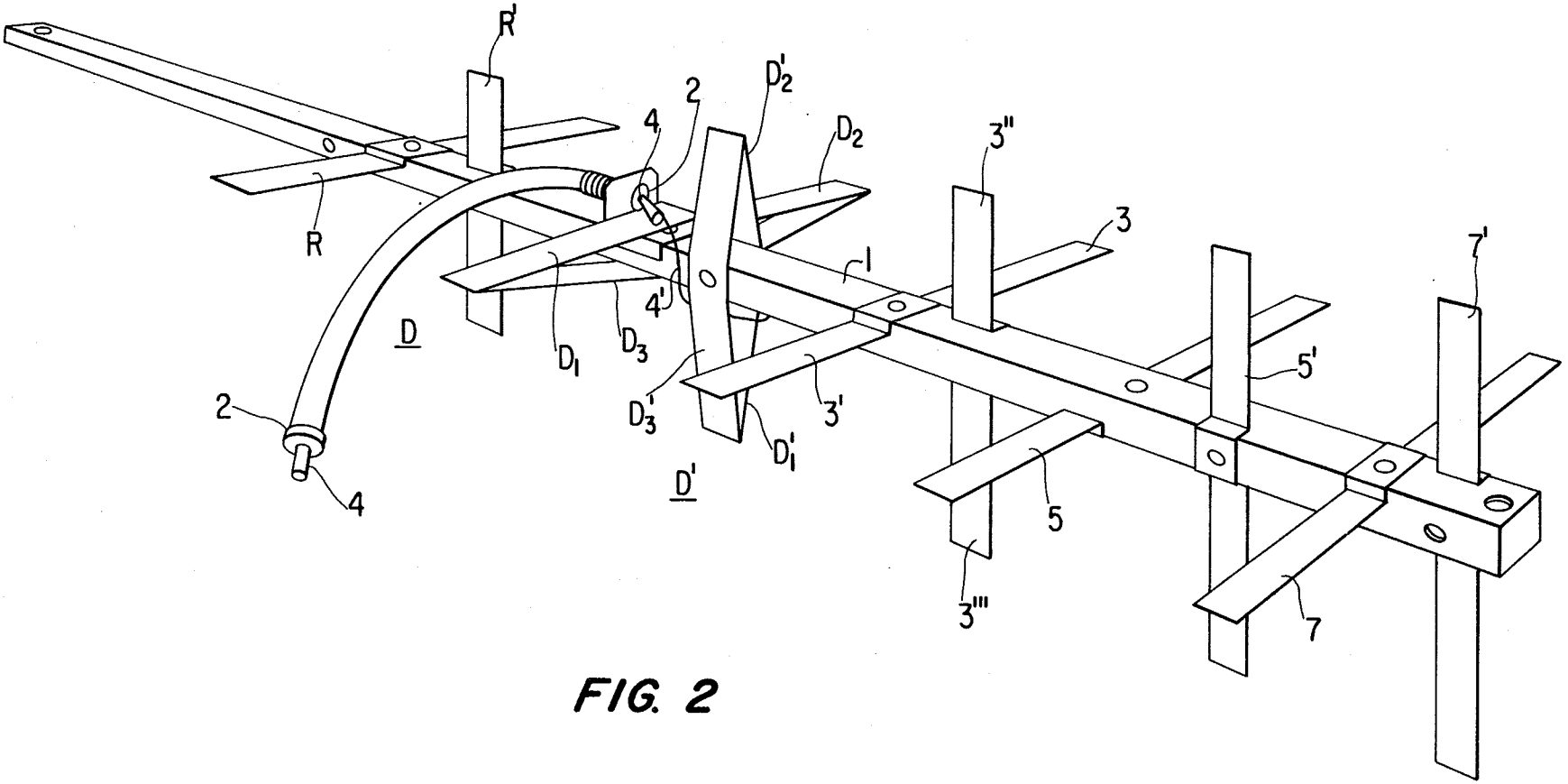
Figure 3:
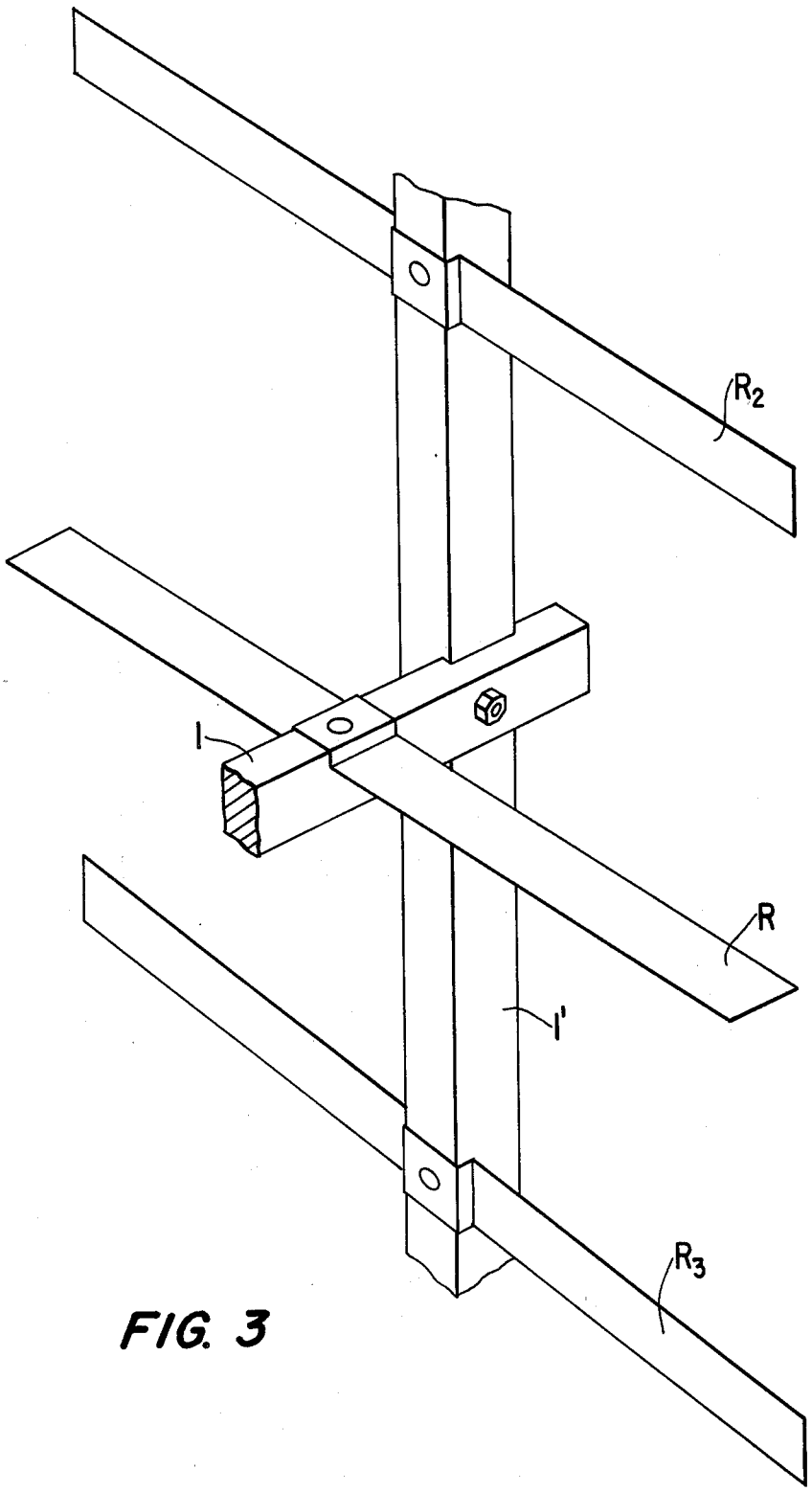

The invention will now be described in connection with the accompanying drawing, FIG. 1 of which is an isometric view illustrating the invention in preferred form;

FIG. 2 is a similar view of a modification adapted for circular polarization; and FIG. 3 is a fragmentary view of a reflector modification.

The Yagi antenna of FIG. 1 is shown disposed upon a conductive boom 1, provided with a folded dipole element D, having side portions $D_1$ and $D_2$ and a remote side $D_3$ folded there-below. The driven side $D_1$ is directly fed by the inner conductor 4 of the coaxial line 2–4, and the undriven side $D_2$ is connected at its inner end to the outer grounded line conductor 2. This feed produces the unbalanced or unsymmetrical phenomenon before discussed. Rearwardly, a conventional parasitic reflector R is mounted on the boom 1. Forwardly of the dipole D, the director parasitic elements are mounted at spaced longitudinal positions in-line with the boom 1, the first element of which is shown at 3—3', and which embodies the asymmetrical configuration underlying the invention. The first director 3—3' is shown positioned on the boom 1 approximately two-tenths of the mean wavelength of the desired band forward of the dipole D; and, in accordance with the present invention, the transverse extension 3 of the director 3—3', adjacent the undriven portion $D_2$ of the dipole, is made slightly longer than the extension 3' adjacent the driven portion $D_1$, in order to attain the results of the invention, as before explained. Subsequent directors, such as 5 and 7 are shown mounted on the boom 1 at successive approximately two-tenths of a wavelength longitudinal spacings, but have symmetrical-length transverse extensions on each side of the boom 1, as in conventional fashion. The dipole antenna D and parasitic elements R, 3—3', 5 and 7 are substantially disposed in a horizontal plane and parallelly arranged to operate for linear horizontal polarization.

As a specific example of an antenna used for channel 68 in the UHF television band, of the order of 795 megahertz at mid-band, the driven element D may have left-hand and right-hand side portions $D_1$ and $D_2$ each of approximately 3.4 inches in length. The reflector R can be symmetrically rearwardly disposed and have an over-all length of about 8 inches. The first director 3—3', in accordance with the present invention, has the unsymmetrical longer extension 3, adjacent and in parallel juxtaposition to the grounded-line-fed portion $D_2$ of the dipole D, of length 3.718 inches; with the other transverse extension 3', parallely adjacent the inner-conductor-line-fed driven element portion $D_1$, being a shorter 3.09 inches. The subsequent directors 5 and 7 may have symmetrical 3.125 inch equal extension lengths on each side of the boom 1, with the spacing between the directors being 3.5 inches.

With the same system in the same channel range without the unsymmetrical director construction of the present invention, dips were produced in the region of the 800 megahertz response, which were unpredictable and uncontrollable, depending upon the number of directors added. Additional increase of the spacing of the directors produced dips just under and above 800 megahertz. Attempts to fix these aberrations, including by adjustment of the reflector, proved very difficult.

By using the unsymmetrical first director of the invention, an unusually flat response occurred across the complete band without any substantial dips in the response and with great stability. It was found that by rendering other successive directors similary unsymmetrical, such as director 5, gave some additional minor improvement. In some cases, furthermore, similarly rendering the reflector element R unsymmetrical in the same sense as described in connection with the director 3—3', aided in rendering the pattern symmetrical and in achieving the stable flat response of the invention. Suitable dimensions of an unsymmetrical reflector R for these frequencies are 4.125 inches on the $D_2$ side, and 3.875 inches on the $D_1$ side. From 5 to 12 directors could be added, moreover, with continued overall flat response unlike the erratic effects occuring in adding different numbers of directors in the prior art antennas of this type.

A 14-element antenna of the design of FIG. 1 produced gains, moreover, that are equivalent or superior to those of a similar properly matched dipole antenna that does not use the folded feed; namely, 13dB in the channel 68 band.

In order to obtain broad-banding response, the directors, as shown in the drawings, are preferably of substantial width, illustrated in the form of rectangular strips mounted on opposite sides of the metal boom 1.

The invention, furthermore, is not restricted to linear polarized antennas such as the horizontally polarized array of FIG. 1, or the same oriented in the vertical plane to provide vertical polarization. The terms horizontal and vertical, of course, are illustrative and generically used. In FIG. 2, the techniques of the invention are shown applied to a circularly polarized arthogonal array antenna which may also be extremely useful for television reception as well as transmission. The horizontal planar array R, D, 3—3', 5, 7 is substantially as described in connection with the embodiment of FIG. 1, and a second similar, but vertical-plane oriented array, R'-D', 3''—3''', 5' and 7', is shown interleaved within the horizontal array, with the elements thereof mounted near the corresponding elements of the horizontal array and having similar element-to-element spacings, and with substantially the same unsymmetrical dimensions of the first director 3''-3''' before explained (and, if desired, subsequent director(s), and/or unsymmetrical reflector R', earlier discussed in connection with reflector R). The appropriate 90° phase shift to achieve circular polarization is shown attained by the appropriate-length insulated inner feed-conductor line extension 4', wrapped clockwise around the boom 1 from inner conductor feed point 4 to the vertical folded dipole driven element $D_1'$, the element $D_2'$being connected through the boom 1 to the outer grounded feed terminal 2. With the dipole elements $D_1'$ and $D_2'$ facing to the right in FIG. 2, and the phase-shifting feed extension 4' wrapped and connected as shown, right-hand rotating circular polarization is achieved; whereas by facing the elements $D_1'$ and $D_2'$ to the left, and wrapping the feed extension 4' oppositely to connect to $D_1'$ on the left-side of the array, left-handed circular polarization is achievable.

This novel construction, moreover, appears to be highly beneficial for circular polarized arrays with symmetrical directors, as well. The construction of the invention is also well-suited for the use of stacked parasitic reflectors and the like as shown in FIG. 3, wherein only the reflector-mounting portion of the boom 1 and the reflector R of FIG. 1 is shown. A vertical boom 1' carrying upper and lower parasitic reflectors $R_2$ and $R_3$ may readily be bolted to one side of the boom 1 adjacent reflector R. The boom 1' may be dimensioned to provide the necessary dimensional off-set for unsymmetrical elements of $R_2$ and $R_3$ as previously discussed in connection with the element R.

Further modifications will occur to those skilled in this art and all such are considered to fall within the spirit and scope of the invention.

What is claimed is:

1. An improved Yagi-type antenna having, in combination, coaxial-line-fed antenna means having first and second portions, the first portion connected to the inner line of a coaxial line having an inner line and an outer line and the second portion connected to the outer line of the coaxial line and thus producing an unsymmetrical pattern; and parasitic conductive means spaced from but near the said antenna means and comprising first and second portions corresponding to and extending substantially parallel to the first and second portions, respectively, of the said antenna means, the second portion of the parasitic conductive means being of greater dimension than the first portion of the parasitic conductive means to introduce compensatory unsymmetrical parasitic interaction to render the pattern symmetrical.

2. An antenna as claimed in claim 1 and in which said parasitic conductive means comprises a director spaced in front of said antenna means and providing said unsymmetrical parasitic interaction.

3. An antenna as claimed in claim 1 and in which said parasitic conductive means comprises a plurality of directors successively spaced in front of said antenna means, each director having first and second portions corresponding to the first and second portions, respectively, of said antenna means and at least the first director of said plurality of directors having its second portion of greater dimension than its first portion.

4. An antenna as claimed in claim 3 and in which a further director of said plurality of directors has its second portion of greater dimension than its first portion.

5. An antenna as claimed in claim 3 and in which said parasitic conductive means comprises parasitic reflector means having first and second portions disposed behind the first and second portions, respectively, of said antenna means and having the second portion of the reflector means of greater dimension than the first portion of the reflector means.

6. An antenna as claimed in claim 5 and in which said parasitic reflector means comprises an array of reflectors with elements thereof disposed out of the plane of said antenna means and directors.

7. An antenna as claimed in claim 1 and in which said antenna means and parasitic conductive means are parallely disposed substantially in a plane to provide linear polarization in said plane.

8. An antenna as claimed in claim 1 and in which a second, similar antenna means and parasitic conductive means oriented in a different plane are mounted in interleaved fashion with the first-named antenna means and parasitic conductive means.

9. An antenna as claimed in claim 8 and in which the planes of the first-named and second similar antenna means and parasitic conductive means are substantially orthogonal, and means is provided for feeding the same to provide for circular polarization.

10. An antenna as claimed in claim 9 and in which the parasitic conductive means of each of the first-named and second orthogonal parasitic conductive means each comprises a director having first and second portions spaced in front of the first and second portions, respectively, of the corresponding antenna means and having the second portion of the director of greater dimension than its first portion.

11. An antenna as claimed in claim 9 and in which the parasitic conductive means of each of the first-named and second orthogonal parasitic conductive means each comprise a reflector having first and second portions spaced in back of the first and second portions, respectively, of the corresponding antenna means and having the second portion of the reflector of greater dimension than its first portion.

12. An antenna as claimed in claim 1 and in which said antenna means comprises a folded dipole mounted transversely upon a longitudinally extending conductive boom, and said parasitic conductive means comprises parasitic reflector means mounted on said boom parallely with and rearward of the dipole and a plurality of directors mounted successively forward of and parallely with the dipole, at least a first director of said plurality of directors being provided with first and second portions corresponding to the first and second portions, respectively, of the antenna means and with the second portion of the director being of greater dimension than its first portion to introduce said unsymmetrical parasitic interaction.

13. An antenna as claimed in claim 12 and in which a parasitic reflector of said reflector means is also provided with first and second portions corresponding to the first and second portions, respectively, of the antenna means and with the second portion of the reflector of greater dimension than its first portion.

14. An improved Yagi-type antenna for circular polarization having, in combination, a first array comprising coaxial-line-fed dipole means mounted transversely upon a longitudinally extending boom and having first and second portions, with the first portion connected to the inner line of a coaxial line having an inner conductor and an outer conductor and with the second portion connected to the outer line of the coaxial line, and parasitic reflector and director means mounted upon said boom respectively rearwardly and forwardly of said dipole means and parallely and in a predetermined plane therewith; and a second array similar to said first array but with its dipole means, parasitic reflector and director means oriented in a plane substantially orthogonal to the said predetermined plane and mounted upon said boom in interleaved fashion with the corresponding dipole means, parasitic reflector and director means of the first array, and with the said first portion of the dipole means of the second array fed from a substantially 90° phase-shift extension of the said inner line, insulatingly carried to said first portion along the boom, with the second portion being connected through the boom to the said outer line of the coaxial line; said parasitic director and reflector means of each of the first and second arrays having at least one of a first director, a first and a second director, and a reflector extending transversely unsymmetrically of the boom to provide greater parasitic interaction on the sides of the boom corresponding to the said second portions of the respective dipole means of the respective arrays.

15. An improved Yagi-type antenna for circular polarization having, in combination, a first array comprising coaxial-line-fed dipole means mounted transversely upon a longitudinally extending boom and having first and second portions, with the first portion connected to the inner line of a coaxial line having an inner line and an outer line and with the second portion connected to the outer line of the coaxial line, and parasitic reflector and director means mounted upon said boom respectively rearwardly and forwardly of said dipole means and parallely and in a predetermined plane therewith; and a second array similar to said first array but with its dipole means, parasitic reflector and director means oriented in a plane substantially orthogonal to the said predetermined plane and mounted upon said boom in interleaved fashion with the corresponding dipole means, parasitic reflector and director means of the first array, and with the said first portion of the dipole means of the second array fed from a substantially 90° phase-shift extension of the said inner line, insulatingly carried to said first portion of the last-mentioned dipole means along the boom, with the said second portion of the last-mentioned dipole means being connected through the boom to the said outer line of the coaxial line.

16. In a Yagi-type antenna and the like provided with an unbalanced-fed dipole having "hot" and grounded-fed sides and a plurality of substantially coplanar parasitic conductive elements disposed in line and parallel with said dipole, a method of compensating for the unsymmetrical dipole pattern caused by the unbalanced dipole feed, that comprises, unsymmetrically interacting one or more of said parasitic elements with the said sides of the dipole by providing greater parasitic conductive interaction adjacent the grounded-fed dipole side than the "hot"-fed side.

17. A method as claimed in claim 16 and in which said unsymmetrical interacting is effected by making the length of the portion of a predetermined parasitic element adjacent the grounded-fed dipole side greater than the length of the portion adjacent the "hot"-fed side.

18. A method as claimed in claim 17 and in which said predetermined parasitic element is a director.

19. A method as claimed in claim 17 and in which said predetermined parasitic element is a reflector.

20. A method as claimed in claim 16 and in which said unsymmetrical interacting is effected by making the length of a portion of each of a reflector and a director parasitic element, disposed respectively rearwardly and forwardly adjacent the grounded-fed dipole side, greater than the length of their respective portions adjacent the "hot"-fed side.

21. A method as claimed in claim 16 and in which said antenna is combined with a similar antenna similarly compensated for said unsymmetrical pattern, and the further steps are performed of orienting the similar antenna in a plane at an angle to the plane of the first-named antenna, and interleaving the same with the corresponding dipole and elements of the first-named antenna.

22. A method as claimed in claim 21 and in which the antennas are orthogonally oriented and the dipole of the said similar antenna is fed in a 90° phase relationship with the dipole of the first-named antenna to provide for circular polarization.

* * * * *